US005500981A

United States Patent [19]

Ho

[11] Patent Number: 5,500,981

[45] Date of Patent: Mar. 26, 1996

[54] LUGGAGE HANDLE ASSEMBLY

[76] Inventor: Shu-Mou Ho, 58, Ma Yuan West St., Taichung, Taiwan

[21] Appl. No.: 301,650

[22] Filed: Sep. 7, 1994

[51] Int. Cl.[6] ..... B25G 1/04

[52] U.S. Cl. ..... 16/115; 280/655; 280/47.315

[58] Field of Search ..... 16/115, 110 R; 190/14, 15 R, 104, 18 R, 18 A; 280/47.315, 47.371, 655, 655.1

[56] References Cited

U.S. PATENT DOCUMENTS

| | | | |
|---|---|---|---|
| 2,926,925 | 3/1960 | Ozlek | 280/47.315 |
| 4,577,877 | 3/1986 | Kassai | 280/47.371 |
| 5,127,664 | 7/1992 | Cheng | 16/115 |
| 5,308,103 | 5/1994 | Chi-Shung | 280/655.1 |
| 5,322,334 | 6/1994 | Hammer | 16/115 |
| 5,351,984 | 10/1994 | Cheng | 280/47.315 |
| 5,371,923 | 12/1994 | Chang | 16/115 |

*Primary Examiner*—P. Austin Bradley
*Assistant Examiner*—Chuck Y. Mah

[57] ABSTRACT

A handle device for luggage includes a pair of tubes slidably engaged in two conduits. A number of depressions are formed in the conduits, and the tubes include a pair of resilient members secured to the lower ends for engaging with the depressions so as to position the tubes relative to the conduits. A handle is secured to the other ends of the tubes. A bar is slidably engaged in the handle and coupled to the resilient members for disengaging the resilient members from the depressions and so as to allow adjustment of the tubes relative to the conduits.

1 Claim, 3 Drawing Sheets

LUGGAGE HANDLE ASSEMBLY

BACKGROUND OF THE INVENTION

1. Field of the Invention

The present invention relates to a handle, and more particularly to a luggage handle assembly.

2. Description of the Prior Art

Typical luggage handles comprise a handle body pivotally coupled to the luggage for carrying purposes. However, normally, the handle body includes a solid configuration that can not be extended.

The present invention has arisen to mitigate and/or obviate the afore-described disadvantages of the conventional luggage handle assemblies.

SUMMARY OF THE INVENTION

The primary objective of the present invention is to provide a luggage handle assembly in which the hand grip may be extended.

In accordance with one aspect of the invention, there is provided a handle assembly comprising a pair of conduits each including a plurality of depressions provided therein, a pair of tubes each including a first end slidably engaged in the conduits respectively and a second end extended outward of the conduits, a pair of resilient members secured to the first ends of the tubes respectively and each including a free end for engaging with the depressions for positioning the tubes relative to the conduits, a handle body secured to the second ends of the tubes and including channel means formed therein, a bar slidably engaged in the channel means and including a hand grip provided thereon, means for biasing the bar toward the tubes, and cable means coupling the bar to the free ends of the resilient members so as to disengage the free ends from the depressions and so as to allow adjustment of the tubes relative to the conduits.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
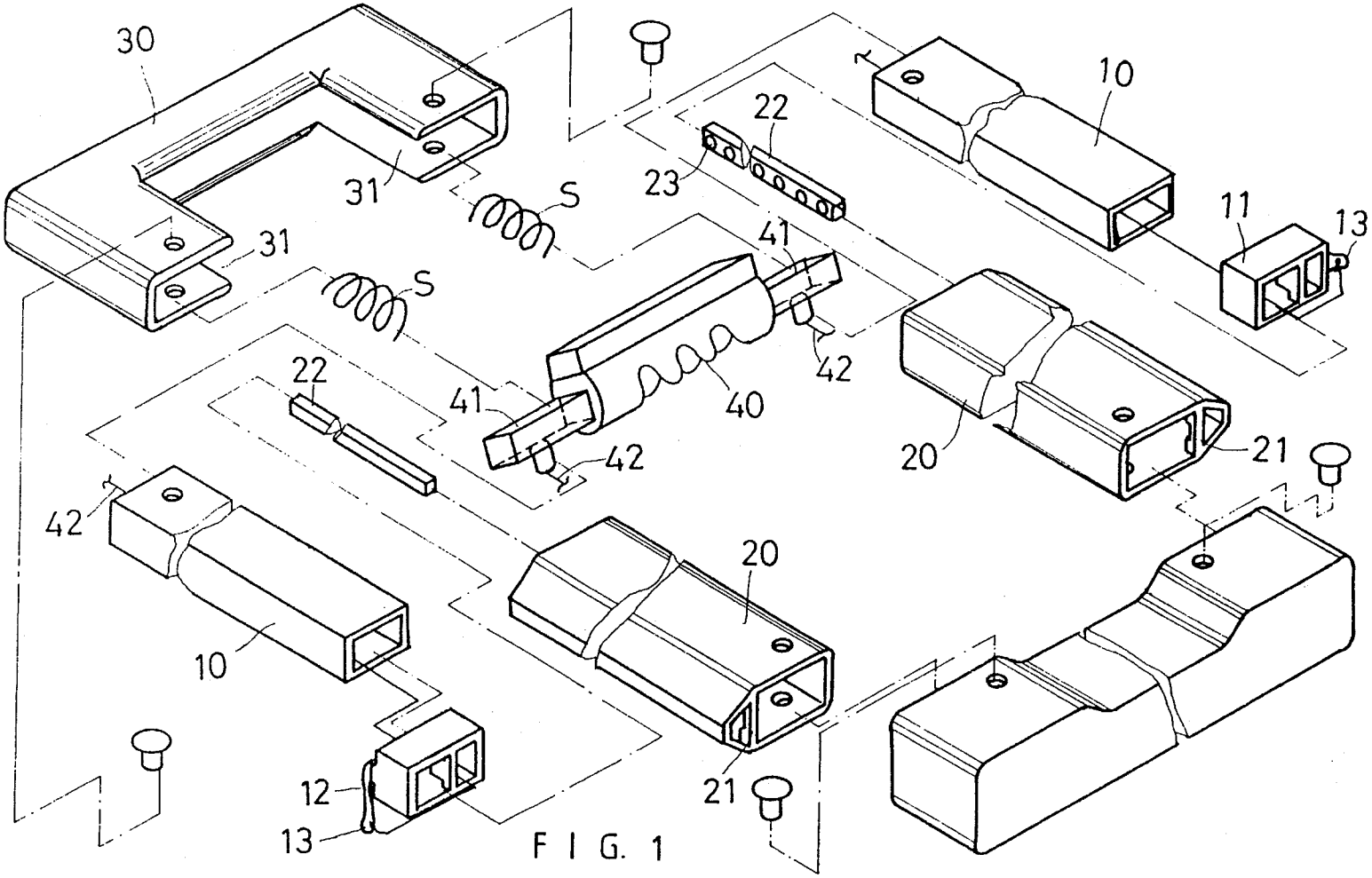
FIG. 1 is an exploded view of a luggage handle assembly in accordance with the present invention.

Referring to the drawings, a luggage handle assembly in accordance with the present invention comprises a pair of conduits 20 including a first end secured to the luggage and including an open second end. Each of the conduits 20 includes a partition 21 formed therein. Two plates 22 are secured to the partitions 21 respectively and each includes a number of depressions 23 formed therein. A pair of tubes include one end slidably engaged in the conduits 20 and having sleeves 11 secured thereto, and the other end extended outward of the conduits 20. The sleeves each includes a resilient member 12 extended therefrom and having a ball member 13 formed in the free end portion for engaging with the depressions 23 of the plates 22.

A handle body 30 is fixed to the other ends of the tubes 10 and includes a pair of channels 31 formed therein. A bar 41 includes two ends slidably engaged in the channels 31 and includes a hand grip 40 provided in the middle portion, a pair of springs S are engaged between the handle body 30 and the bar 41 for biasing the bar 41 toward the tubes 10. A pair of cables 42 are coupled between the resilient members 12 and the ends of the bar 41.

Figure 2:
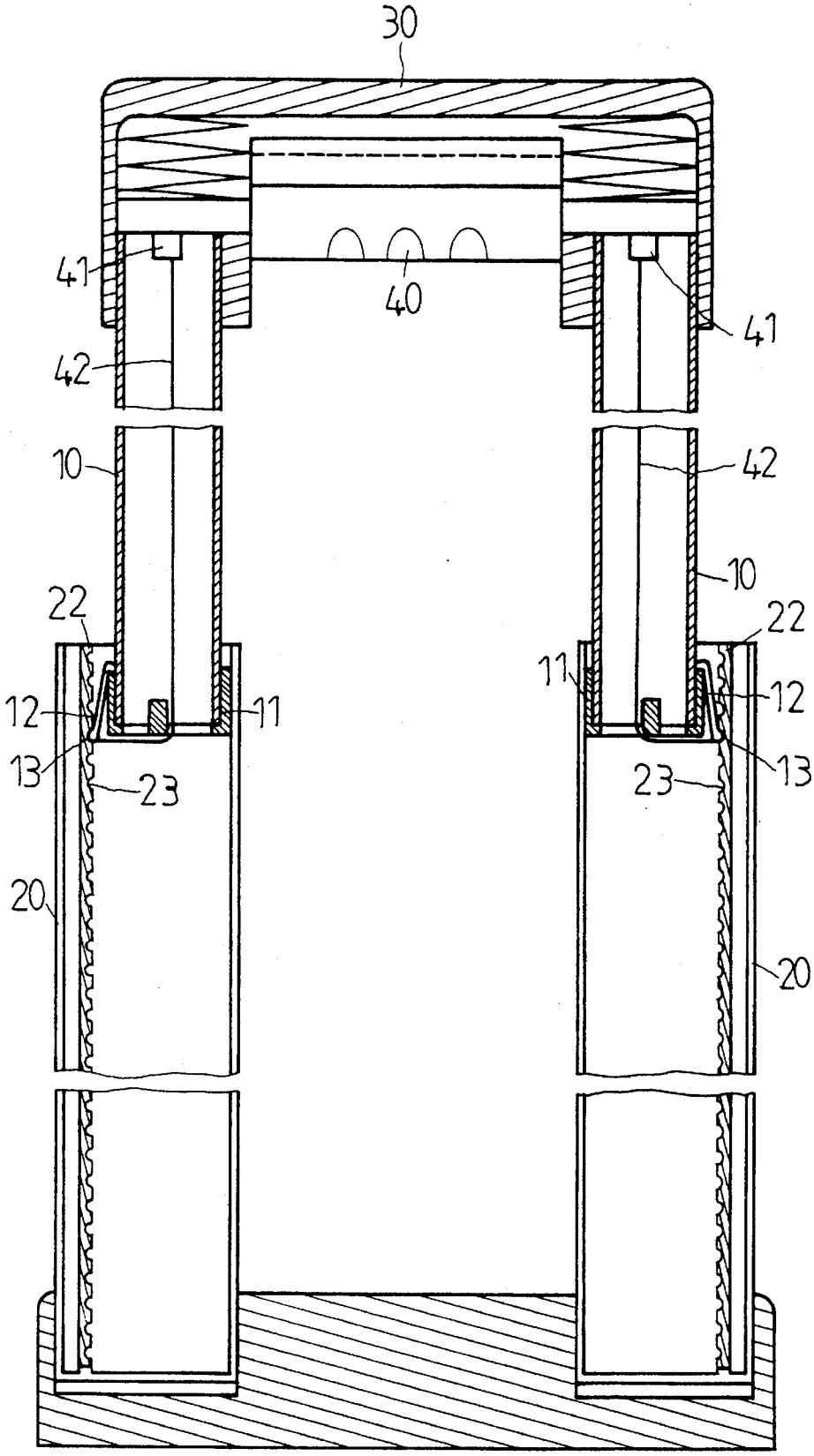
FIG. 2 is a cross sectional view of the luggage handle assembly.
Figure 3:
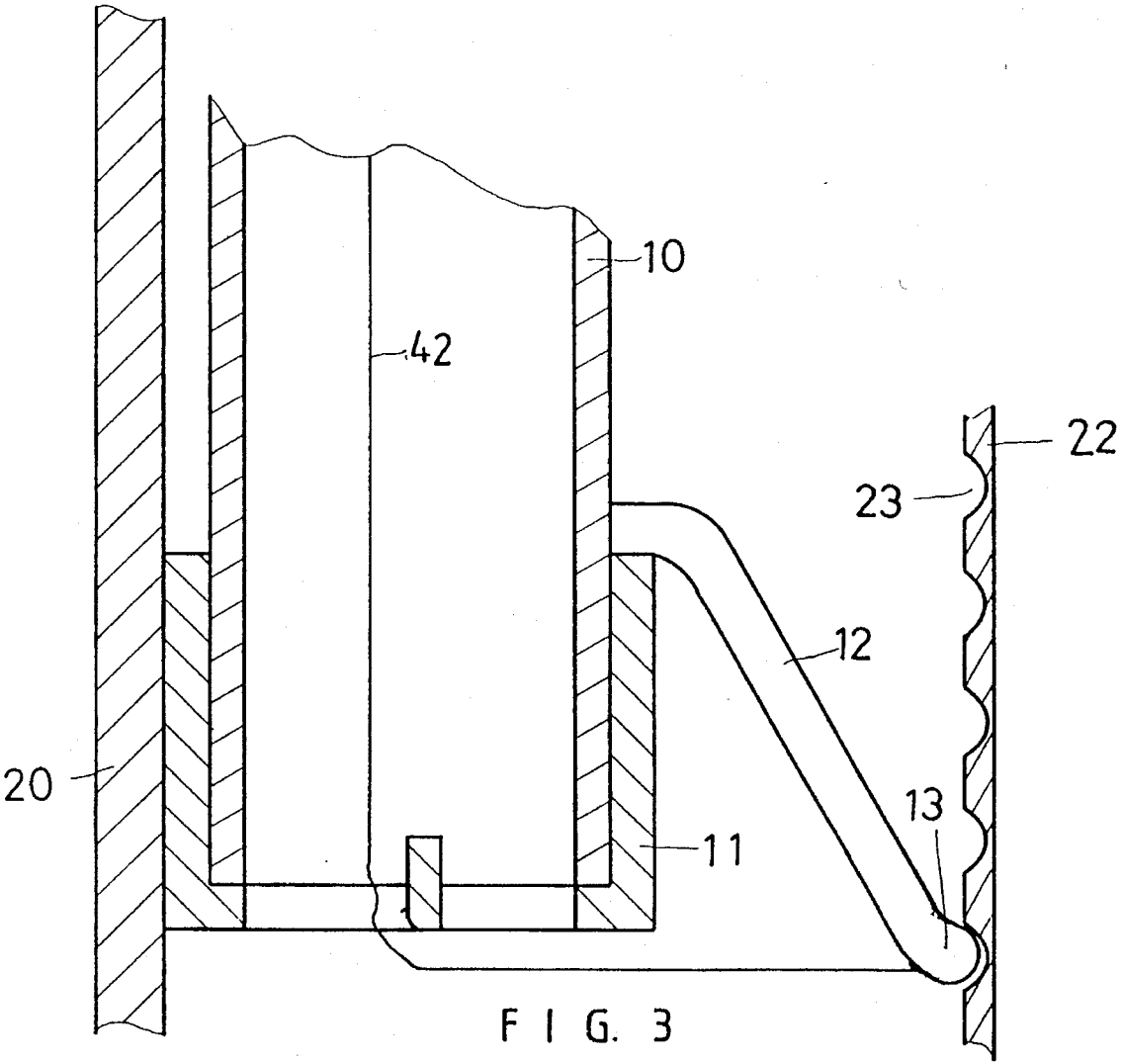
FIG. 3 is an enlarged cross sectional view illustrating portion of the handle assembly.

In operation, as shown in FIGS. 2 and 3, the tubes 10 may move relative to the conduits 20 and may be stably secured in place relative to the conduits 20 when the ball members 13 of the resilient members 12 are engaged with either of the depressions 23. When the hand grip 40 is pulled away from the tubes 10 against the springs S, the ball members 13 may be disengaged from the depressions 23 by the cables 42 such that the tubes 10 may slide freely relative to the conduits 20. When the hand grip 40 is released, the ball members 13 may engage with the depressions 13 again so as to retain the tubes 10 in place relative to the conduits 20.

Accordingly, the luggage handle assembly in accordance with the present invention includes a handle body that may be adjusted relative to the conduits.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly comprising:

a pair of conduits each including a plurality of depressions provided therein, a pair of tubes each including a first end slidably engaged in said conduits respectively and a second end extended outward of said conduits, a pair of resilient members secured to said first ends of said tubes respectively and each including a free end for engaging with said depressions for positioning said tubes relative to said conduits, a handle body secured to said second ends of said tubes and including channel means formed therein, a bar slidably engaged in said channel means and including a hand grip provided thereon, means for biasing said bar toward said tubes, and cable means coupling said bar to said free ends of said resilient members so as to disengage said free ends from said depressions and so as to allow adjustment of said tubes relative to said conduits.

* * * * *